US005421437A

United States Patent [19]

Malachowski

[11] Patent Number: 5,421,437

[45] Date of Patent: Jun. 6, 1995

[54] UNIT GUIDE WEAR PLATE

[75] Inventor: Jerome A. Malachowski, Hamburg, N.Y.

[73] Assignee: Buffalo Brake Beam Company, Buffalo, N.Y.

[21] Appl. No.: 81,667

[22] Filed: Jun. 23, 1993

[51] Int. Cl.[6] ..... B61H 3/00

[52] U.S. Cl. ..... 188/233.3; 188/52

[58] Field of Search ..... 188/52, 53, 54, 55, 188/214, 205 R, 209, 233.3, 212

[56] References Cited

U.S. PATENT DOCUMENTS

| | | | |
|---|---|---|---|
| 2,350,671 | 8/1941 | Busch | 182/212 |
| 2,553,345 | 5/1951 | Willis | 188/212 |
| 2,808,906 | 10/1957 | Busch | 188/233.3 |
| 2,918,149 | 12/1959 | McClure et al. | 188/214 |
| 2,974,758 | 3/1961 | Ekholm | 188/233.3 |
| 3,020,984 | 2/1962 | Le Beau | 188/233.3 |
| 4,463,835 | 8/1984 | Murphy et al. | 188/52 |
| 4,463,836 | 8/1984 | Murphy et al. | 188/52 |
| 4,471,857 | 9/1984 | Murphy | 188/52 |
| 4,480,721 | 11/1984 | Murphy | 188/52 |

*Primary Examiner*—Mark T. Le

*Attorney, Agent, or Firm*—Kellie M. Muffoletto; Saperston & Day

[57] ABSTRACT

A unit guide wear plate which aligns the movement of a brake beam end guide within the side frame of a railroad car truck so that the brake shoes can provide the maximum amount of force against the wheels when stopping the railroad car. The unit guide wear plate is comprised of a wear plate body, having a u-shaped cross section, a first side wall, having a first inner surface and a first outer surface; a second side wall, having a second inner surface and a second outer surface; a third side wall having a third inner surface and a third outer surface; wherein the first side wall is located such that it is attached to the third side wall opposite the second side wall; a first flange extension protruding from the first side wall and a second flange extension protruding from the second side wall; a pair of dimples arising out of the second outer surface for securing the unit guide wear plate within a railroad car side frame; a spring tang for providing a lateral force on a brake beam end guide as it lies within the unit guide wear plate body; and a first ramp extending outward from the first inner surface and a second ramp extending outward from the second inner surface, for aligning the brake beam end guide within the unit guide wear plate body.

22 Claims, 2 Drawing Sheets

FIG. 1.
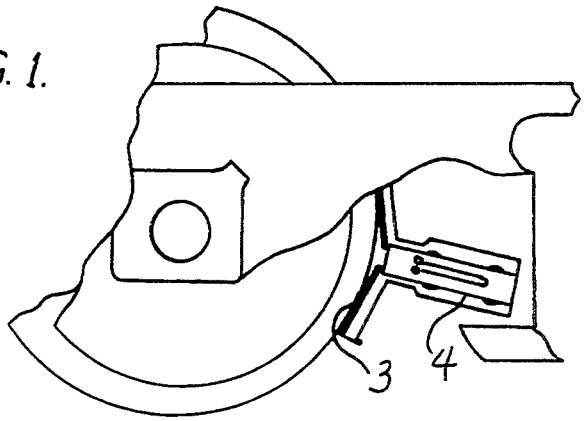
FIG. 2.
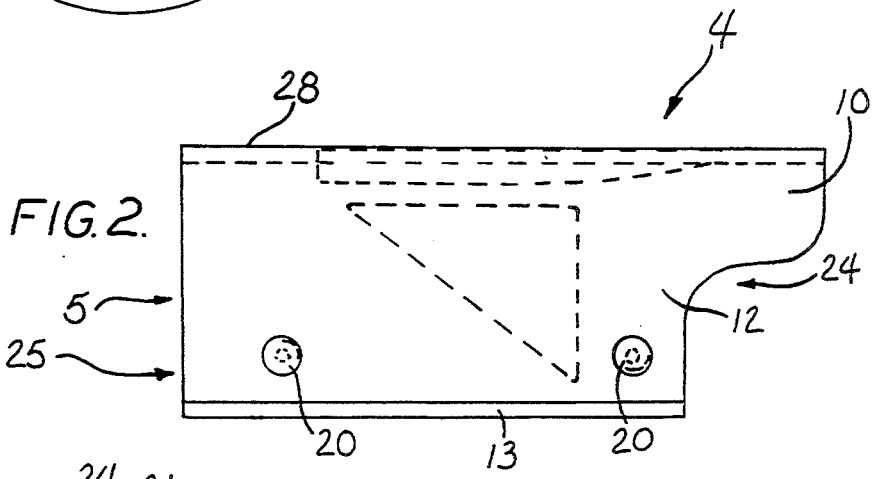
FIG. 3.
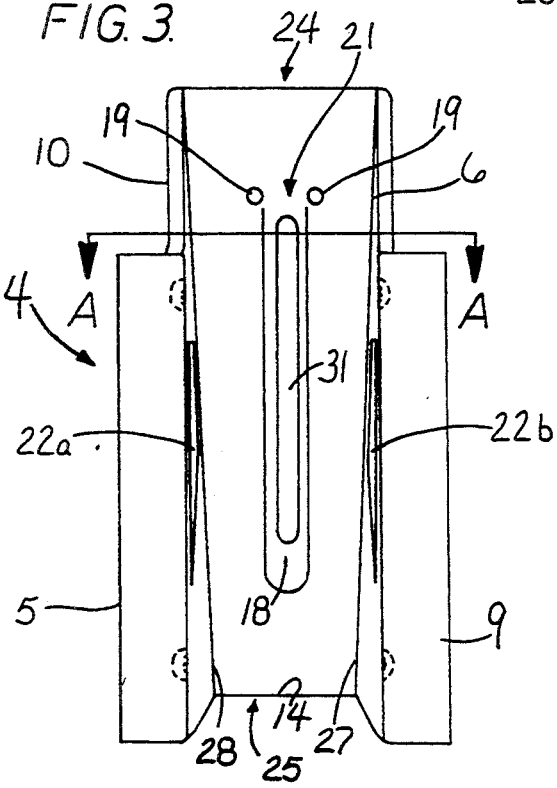
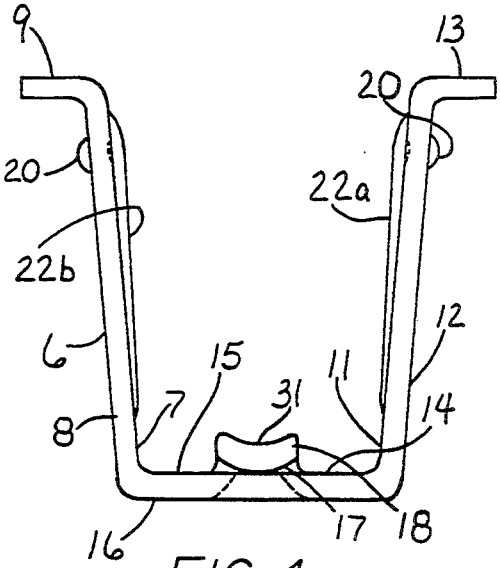
FIG. 4.

UNIT GUIDE WEAR PLATE

FIELD OF THE INVENTION

This invention relates to unit guide wear plate for aligning and mounting a brake beam within a railroad car. In particular, it relates to unit guide wear plate designed to minimize the lateral and rotational motion of the brake beam, thereby, reducing wear and increasing braking efficiency.

BACKGROUND OF INVENTION

Brake beams are a component of the railroad car braking system. They transmit the translational motion and forces of the brake rods across the car and onto the brake shoes. The brake beam heads are a component of the brake beam that exert a force directly on the brake shoes. The brake heads must be positioned so that they exert a maximum force which is proportioned evenly along the brake shoes. Railroad freight car trucks are assembled in a loosely fitting manner, in order to easily accommodate manufacturing tolerances of parts and track irregularities. Therefore, railroad component manufacturers generally provide products which are easily assembled and which are not sensitive to imperfections in the fittings.

The unit guide wear plate is a device which fits inside the side frame of a railroad car proximate to the brake beam and the brake shoes. The function of the unit guide wear plate is to receive the brake beam end guide and to align its motion toward the wheels upon the application of the brake. For functional purposes the brake beam end guide must fit loosely within the unit guide wear plate. This requirement creates additional problems which need to be compensated in the design of components, such as the unit guide wear plate.

The brake beam end guide can travel approximately one inch between its retracted position and its braking position. Excessive looseness between brake beam end guides and their corresponding unit guide wear plates promote uneven wear of the brake shoes, the brake beam end guides, and the unit guide wear plates. This excess wear results in a costly and time consuming replacement process and creates burdensome maintenance problems for all railroad companies. Not only do the companies have to constantly replace the brake shoes, but there is also a costly need to repair and replace the brake beams themselves. With four brake beams and eight brake shoes per car, a substantial amount of repair is required of the railroad to maintain its fleet.

In general, the unit guide wear plates are the only means for guiding the motion of the brake beam end guide and for providing support against the effects of gravity. However, because the unit guide wear plate is required to loosely receive the brake beam end guide, the design of the current unit guide wear plates cannot accomplish this task without having the brake beam sag or droop. The drooping movement of the brake beam affects the nose of the brake beam and subjects the upper ends of the brake shoes to excessive wear. It also rotates the brake beam end guide within the unit guide wear plate such that additional pressure is exerted on the lower forward portion and the upper back portion of the brake beam end guide and the unit guide wear plate. This creates additional frictional resistance for the brake beam end guide and prevents the brake beam end guide from exerting a maximum pressure on the brake shoes and wheels. Thus, this defeats the purpose of having the brake beam end guide fit loosely within the wear plate, which is to provide compensation for the misalignment of other components of the braking system.

After a half million miles or so, the brake beam end guides and unit guide wear plates also wear significantly, thus requiring that the subject components be repaired or replaced. Continued operation under these conditions results in increasingly uneven brake shoe wear and diminished retraction of the brake beam end guide in the brake off position. Previous designs of the unit guide wear plate have attempted to solve these problems, but despite their efforts there still exists a need in the industry to adequately, economically, and efficiently resolve these problems.

U.S. Pat. No. 4,471,857, "Guide Bearing For Mounting Unit Brake Beams", by Murphy, contemplates solving some of these problems with a plastic wear plate design. However, in practice, this new design has not solved the drooping problem of the brake beam and has not created a component which is free from excessive wear. In fact, the plastic materials contemplated by this invention have exhibited a higher degree of wear than hardened steel designs. Furthermore, the brake beam end guides have not found a substantial coplaner cock free alignment in these new homes.

The Murphy patent also discloses an integral clip arm as part of the guide bearing wear plate. The effect of this clip arm has been to reduce the brake beam movement by a half an inch and in some cases prevent the application of the brake altogether.

In addition, to the problems created by the unwanted rotational movement of the brake beam, there exists an unwanted lateral movement of the brake beam which may cause unwanted wheel flange wear.

There have been past attempts to solve this problem by incorporating a spring inside the unit guide wear plate. However, given the dimensional constraints of the unit guide wear plate, these spring designs have been unable to fully react against the lateral force. Moreover, these spring designs have had a tendency to fail, causing the unit guide wear plate to crack and thereby, requiring replacement of the unit guide wear plate.

The nestling of the unit guide wear plate within the railroad freight car truck creates a difficult maintenance environment. In order to remove the unit guide wear plate, a series of heavy and burdensome parts must be lifted and set aside. The brake rigging must be disconnected, the side frames lifted and moved apart, the wheels rolled away and the brake beam itself must also be removed. Once the unit guide wear plate is removed and replaced the process must be reversed in order to reconnect the components. Therefore, there is a definite need in the railroad industry for long lasting, wear resistant, unit guide wear plates.

Current spring designs are created by a partial punch through an end wall of the wear plate. The spring has a tendency to break off at its anchoring point. In order to prevent the cracks from propagating into the remaining portion of the unit guide wear plate, two parallel holes are punched at the base of the spring. However, because manufacturing processes make it impossible to punch these holes exactly on a tangent, their net effect reduces the available spring force.

Therefore, there is a need to create a wear plate design which incorporates the concept of the spring component and which minimizes the failure of the spring and which also improves the spring rate. However, these new designs are generally limited to the confining dimensional requirements of the already existing components of the railroad car and braking system.

In addition, there is a need that such a design to be easily manufactured under current ,manufacturing processes without a burdensome increase in labor involved in manufacturing the wear plate.

SUMMARY OF THE INVENTION

The present invention is a unit guide wear plate which aligns the movement of a brake beam end guide within the side frame of a railroad car truck so that the brake shoes can provide the maximum amount of force against the wheels when stopping the railroad car. The unit guide wear plate is comprised of a wear plate body, having a u-shaped cross-section. The unit guide wear plate body is comprised of a first side wall, a second side wall, a third side wall, a first open end, a second open end, a first flange extension, and a second flange extension. The first side wall is located such that, it is attached to the third side wall opposite the second side wall. Likewise, the second side wall is attached to the third side wall such that, it is located opposite said first side wall. The first side wall has both a first outer surface and a first inner surface. The second side wall has a second outer surface and a second inner surface, wherein, the second inner surface directly faces opposite the first inner surface of the first side wall. The third side wall has a third outer surface and a third inner surface. The first flange extension protrudes outward from the first side wall while the second flange extension protrudes outward from the second side wall.

In addition to the described wear plate body this invention is comprised of at least one means for securing the invention within a railroad car side frame. The invention also includes a means for providing a lateral force on the brake beam end guide as it lies within the unit guide wear plate body. In the preferred embodiment the means for providing a lateral force is a spring tang, having a curved top surface.

The unit guide wear plate of this invention is also comprised of a means for aligning the brake beam end guide within the unit guide wear plate body. In the preferred embodiment this means for aligning is a first ramp extending outward from the first inner surface and a second ramp extending outward from the second inner surface, wherein the first ramp has a greater displacement at points proximate to the first flange extension then at points proximate the third side wall, and likewise, wherein the second ramp has a greater displacement at points proximate to the second flange extension then at points proximate the third side wall.

Accordingly, it is an object of this invention to provide a unit guide wear plate which can fit inside the side frame of a railroad car in order to receive the brake beam end guide and to align its motion towards the wheels upon the application of the brake.

A more particular object of this invention is to provide a unit guide wear plate which allows a brake beam end guide to fit loosely within, in order to accommodate manufacturing variations of railroad car components and to compensate for irregularities in the components.

Still, another object of this invention is to provide a unit guide wear plate whose design will reduce the rotational movement of the brake beam and thereby reduce the uneven wear of the brake shoes, the brake beam end guide, and the unit guide wear plate.

Yet, another object of the invention is to provide a unit guide wear plate with a spring component having an increased spring rate and a minimal failure rate.

Still, yet another, object of the invention is to provide a unit guide wear plate which eliminates the problems created by the unwanted rotational and lateral movement of the brake beam.

Yet, a more particular, object of the invention is to provide a unit guide wear plate whose design reduces: the effect of compounded wear created by the sliding components; the loss of unusable brake shoe material; the attendant cost of replacing brake shoes more often than would normally be expected; and possible costly damage to brake beams and wheels when brake shoes unexpectedly wear through.

BRIEF DESCRIPTION OF DRAWINGS

FIG. 1 is a partial cutaway view of a railroad sidecar revealing the relative positions of the unit guide wear plate, the brake shoes, and the railroad car wheel.

FIG. 2 is a view of the second side wall of the unit guide wear plate body.

FIG. 3 is a schematic of the unit guide wear plate revealing the inner surfaces.

FIG. 4 is a view of the unit guide wear plate taken along line A—A of FIG. 3.

DETAILED DESCRIPTION OF INVENTION

Figure 5:
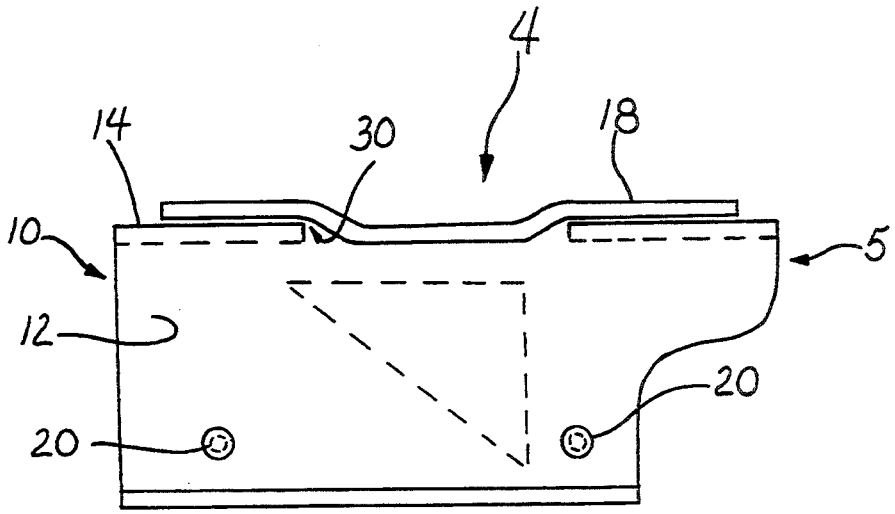
FIG. 5 is a schematic of an alternate embodiment of a unit guide wear plate having a separate spring component.

FIG. 1 is a partial cutaway of railroad sidecar frame 1, revealing the position of unit guide wear plate 4 in orientation with brake shoe 3 and railroad car wheel 2.

FIG. 2 is a top view of unit guide wear plate 4 revealing second side wall 10, in connection with third side wall 14, (see FIG. 3), first open end 24 and second open end 25 of unit guide wear plate body 5. Means for securing unit guide wear plate body within side frame 20 is, in the preferred embodiment, a pair of dimples arising out of second outer surface 12, approximate second flange extension 13.

FIG. 3 is a schematic of unit guide wear plate 4 revealing the inside surfaces of wear plate body 5. Wear plate body 5, having a U-shape cross-section (see FIG. 4), is comprised of first sidewall 6, second sidewall 10, third side wall 14, first open end 24, second open end 25, first flange extension 9, and second flange extension 13.

The first sidewall connects to the third side wall along first edge 27 and opposite the second sidewall. Wherein the first edge is defined by the intersection of the planes of the first sidewall and the third side wall. Likewise, the second sidewall connects to the third side wall along second edge 28 and opposite the first side wall. First open end is opposite and distal to second open end and is proximate to platform 17 (shown in FIG. 4).

As further illustrated in FIG. 4, the first sidewall is defined by first outer surface 8 and first inner surface 7. The second sidewall is deformed by second outer surface 12 and second inner surface 11. While the third side wall is defined by third outer surface 16 and third inner surface 15.

Returning to FIG. 3, first flange extension 9 protrudes from the first sidewall and second flange extension 13 protrudes from the second sidewall. The first and second flange extensions buttress against the inner facing surfaces of the railroad side frame outside the aperture within the side frame known as unit guide bracket which receives the unit guide wear plate.

In the preferred embodiment, the means for providing a lateral force on said brake beam and guide, is a spring tang 18, as depicted in FIG. 3. In the preferred embodiment the spring tang is form pressed out of the third side wall. In alternate embodiments, the spring tang can be mounted to the inner surface of the third side wall. As another alternative, the spring tang may be a separate component from the wear plate body as depicted in FIG. 5. This separate spring tang fits loosely into a punch slot 30 in the third side wall of the wear plate body.

In the preferred embodiment of the spring tang, means for stopping cracks 19, is a pair of tangentially aligned apertures located in the third inner surface of the third side wall (see FIG. 3).

The design of the spring tang as described in this invention, effectively increases the thickness of the spring tang (see FIG. 4) which thereby increases the resulting moment of inertia. The spring tang design incorporates curvature 31 (See FIG. 3) and shaped indentation 32 (See FIG. 4). A doubling of the spring rate is produced by increasing the width of the spring tang and incorporating a shaped indentation, which effectively increases the thickness of the spring tang. The preferred embodiment of the spring tang has both a curvature and a shaped indentation. However, alternate embodiments may include only the curvature or the shaped indentation.

Figure 6:
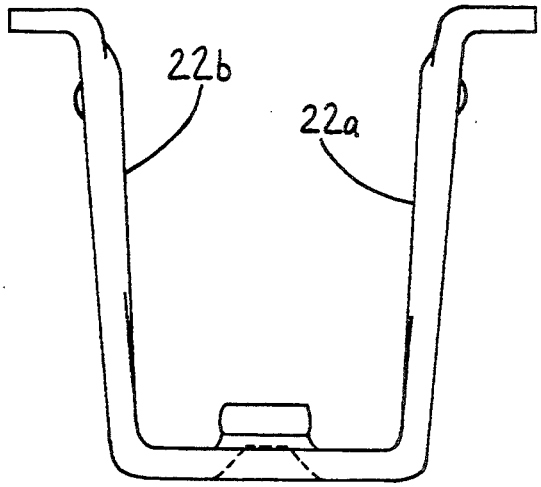
FIG. 6 is an alternate embodiment of the unit guide wear plate shown in FIG. 4, wherein the ramp component of the wear plate body is pressed formed.

As further depicted in FIG. 3, the preferred embodiment of means for aligning said brake beam and guide within said wear plate body 22, is first ramp **22-*a* and second ramp 22-*b*, wherein said ramps are press formed out of the first side wall and second side wall respectively, as shown by FIG. 6. This produces a displacement of the first side wall and the second side wall. In alternate embodiments, the first ramp and the second ramp are mountably attached to the first inner surface and a second inner surface respectively, as shown by FIG. 4. Also, in the preferred embodiment, the first ramp and the second ramp are of a constant thickness, or displacement, (i.e., depending on whether they are mounted or form pressed). However, in an alternate embodiment, the first ramp and second ramp may be of varying thickness, (or displacement, as appropriate), such that the first ramp has a greater thickness, (or displacement, as appropriate), at points proximate the first flange's extension then at points proximate the third side wall and wherein, the second ramp has a greater thickness, (or displacement, as appropriate), at points proximate said second flange extension then at points proximate said third side wall (see FIG. 4**).

FIG. 4 is a view of unit guide wear plate taken along line A—A of FIG. 3. In this figure the preferred means for securing the unit guide wear plate within the side frame is at least one dimple 20 protruding from first outer surface 8 and second outer surface 12. In the preferred embodiments, spring tang 18 and platform 17 are form molded from an integral part of end wall 14. In alternate embodiments, the spring tang can be canter levered at first point 21 located on the third inner surface, (as shown in FIG. 3), wherein the first point is proximate first open end 24 (see FIG. 2 and FIG. 3). In the alternate embodiment, the platform is mountably attached to and between the third inner surface at the first point and the spring tang.

Although, for the purpose of describing this invention, certain terms have been used for the purpose of indicating spacial orientation, however it should be noted that the invention described herein is not limited to such designations of spacial orientation. In light of the nature of a railroad car side frame and the fact that there are a pair of opposing brake beams within each railroad car, the upper portion of the invention as described herein, may in certain instances in fact, be the lower portion of the unit guide wear plate.

I claim:

1. A unit guide wear plate, for aligning the movement of a brake beam end guide, comprising:

a) a wear plate body, having a U-shape cross-section, wherein said wear plate is comprised of a first sidewall, a second sidewall, a third side wall, a first open end, a second open end, a first flange extension, and a second flange extension;

wherein said first sidewall is located on said [end wall]third side wall opposite said second sidewall;

said first sidewall having a first outer surface and a first inner surface;

said second sidewall having a second outer surface and a second inner surface;

said third side wall having a third outer surface and a third inner surface;

wherein said first flange extension protrudes outward from said first sidewall and said second flange extension protrudes outward from said second sidewall;

b) at least one dimple, wherein said dimple protrudes from said first outer surface;

c) a spring tang comprised of a top surface having a curvature and a shaped indentation; wherein said spring tang is mountably attached to a platform; wherein said platform is mounted to said third inner surface, such that, said spring tang is cantilevered at a first point on said third inner surface; wherein said first point is proximate said first open end; wherein said first open end is opposite and distal to said second open end and said first open end is proximate to said platform;

d) said third inner surface having at least one aperture; wherein said aperture is tangentially positioned at said first point;

e) a first ramp extending outward from said first inner surface and a second ramp extending outward from said second inner surface; wherein said first ramp has a greater thickness at points proximate said first flange extension than at points proximate said third side wall and said second ramp has a greater thickness at points proximate said second flange extension that at points proximate said third side wall.

2. A unit guide wear plate, for aligning the movement of a brake beam end guide, comprising:

a) a wear plate body, having a u-shaped cross section, wherein said unit guide wear plate is comprised of a first side wall, second side wall, a third side wall, first open end, a second open end opposite and distal to said first open end, a first flange extension, and a second flange extension; wherein said first side wall is located on said third side wall opposite said second side wall; said first side wall having a first outer surface and a first inner surface; said second side wall having a second outer surface and a second inner surface; said third side wall having a third outer surface and a third inner surface; wherein said first flange's extension protrudes outward from said first side wall and said second flange extension protrudes outward from said second side wall;

b) at least one dimple, wherein said dimple protrudes from said first outer surface;

c) a spring tang, wherein said spring tang is an integral part of said third side wall; and d) a first ramp, wherein said first ramp is a rigid and non-yielding structure and is an integral part of said first inner surface.

3. The unit guide wear plate as described in claim 2 wherein said means for providing a lateral force on said brake beam end guide within said wear plate body, is a spring tang having a curvature.

4. The unit guide wear plate as described in claim 2 wherein said means for providing a lateral force on said brake beam end guide is a spring tang having a shaped indentation.

5. The unit guide wear plate as described in claim 2 wherein said means for providing a lateral force on said brake beam end guide is a spring tang having a curvature and a shaped indentation.

6. The unit guide wear plate as described in claim 2 further comprising a second ramp; wherein said second ramp is an integral part of said second sidewall.

7. A unit guide wear plate, for aligning the movement of a brake beam end guide, comprising:

a) a wear plate body, having a U-shape cross-section, wherein said wear plate is comprised of a first sidewall, a second sidewall, a third side wall, a first open end, a second open end, opposite and distal to said first open end, a first flange extension, and a second flange extension;

wherein said first sidewall is located on said third side wall opposite said second sidewall;

said first sidewall having a first outer surface and a first inner surface;

said second sidewall having a second outer surface and a second inner surface;

said third side wall having a third outer surface and a third inner surface;

wherein said first flange extension protrudes outward from said first sidewall and said second flange extension protrudes outward from said second sidewall;

b) a spring tang extending from said third inner surface;

c) a first ramp extending outward from said first inner surface and a second ramp extending outward from said second inner surface; wherein said first and second ramps are rigid and non-yielding structures.

8. The unit guide wear plate as described in claim 7 further comprising at least one dimple, wherein said dimple protrudes from said first outer surface.

9. The unit guide wear plate as described in claim 7 wherein said third inner surface has at least one aperture; said aperture tangentially positioned at a first point.

10. The unit guide wear plate as described in claim 7 wherein said spring tang is comprised of a top surface having a curvature and a shaped indentation.

11. The unit guide wear plate as described in claim 7 wherein said spring tang fits loosely into a punch slot in said third side wall.

12. The unit guide wear plate as described in claim 7 wherein said spring tang is press formed from said third side wall.

13. The unit guide wear plate as described in claim 7 wherein said first ramp is an integral part of said first inner surface and said second ramp is an integral part of said Second inner surface.

14. The unit guide wear plate as described in claim 7 wherein said first ramp is mountably attached to said first inner surface and said second ramp is mountably attached to said second inner surface.

15. The unit guide wear plate as described in claim 7 wherein said first ramp has a greater thickness at points proximate said first flange extension than at points proximate said third side wall; and wherein said second ramp has a greater thickness at points proximate said second flange extension that at points proximate said third side wall.

16. The unit guide wear plate as described in claim 7 wherein said first ramp is of a constant thickness and wherein said second ramp is of a constant thickness.

17. A unit guide wear plate, for aligning the movement of a brake beam end guide, comprising:

a) a wear plate body, having a U-shape cross-section, wherein said wear plate is comprised of a first sidewall, a second sidewall, a third side wail, a first open end, a second open end, opposite and distal to said first open end, a first flange extension, and a second flange extension;

wherein said first sidewall is located on said third side wall opposite said second sidewall;

said first sidewall having a first outer surface and a first inner surface;

said second sidewall having a second outer surface and a second inner surface;

said third side wall having a third outer surface and a third inner surface;

wherein said first flange extension protrudes outward from said first sidewall and said second flange extension protrudes outward from said second sidewall;

b) at least one means for securing said unit guide wear plate within a railroad car side frame;

c) a rigid and non-yielding ramp means for aligning said brake beam end guide within said unit guide wear plate body; and d) a means for providing a lateral force on said brake beam end guide within said wear plate body.

18. The unit guide wear plate as described in claim 17 wherein said means for providing a lateral force is a spring tang, wherein said spring tang is proximate to said third side wall being cantilevered at a first point on said third inner surface; wherein said first point is proximate said first open end.

19. The unit guide wear plate as described in claim 17 wherein said means for providing a lateral force is a spring tang; wherein said spring tang fits loosely into a punch slot in said third side wall of said wear plate body.

20. The unit guide wear plate as described in claim 17 wherein said means for securing said wear plate is at least one dimple; wherein said dimple protrudes from said first outer surface.

21. The unit guide wear plate as described in claim 17 wherein said means for aligning is a first ramp mountably attached to said first inner surface and a second ramp mountably attached to said second inner surface.

22. The unit guide wear plate as described in claim 17 wherein said means for aligning is a first ramp being an integral part of said first inner surface and a second ramp being an integral part of said second inner surface.

* * * * *